US007549240B2

(12) United States Patent
Casagrande

(10) Patent No.: US 7,549,240 B2
(45) Date of Patent: Jun. 23, 2009

(54) EXCAVATION DEVICE

(75) Inventor: Mauro Casagrande, Sacile (IT)

(73) Assignee: Casagrande SpA, Fontanafredda (IT)

( * ) Notice: Subject to any disclaimer, the term of this patent is extended or adjusted under 35 U.S.C. 154(b) by 149 days.

(21) Appl. No.: 11/735,181

(22) Filed: Apr. 13, 2007

(65) Prior Publication Data

US 2007/0245599 A1 Oct. 25, 2007

(30) Foreign Application Priority Data

Apr. 21, 2006 (IT) ..... UD2006A0106

(51) Int. Cl.
*E02F 5/08* (2006.01)

(52) U.S. Cl. ..... 37/91; 37/462; 37/189; 37/465; 37/352

(58) Field of Classification Search ..... 37/189, 37/365, 385, 396, 401, 91, 462, 465, 352; 175/91, 96, 101, 104; 299/38.1, 39.1, 39.3, 299/39.6

See application file for complete search history.

(56) References Cited

U.S. PATENT DOCUMENTS 3,710,878 A * 1/1973 Endo et al. ..... 175/66
5,111,601 A * 5/1992 Casagrande ..... 37/91

FOREIGN PATENT DOCUMENTS

| | | |
|---|---|---|
| JP | 63251518 | 10/1988 |
| JP | 63312415 | 12/1988 |
| JP | 06336749 | 12/1994 |
| JP | 07305345 | 11/1995 |
| JP | 2000160592 | 6/2000 |

* cited by examiner

*Primary Examiner*—Thomas B Will
*Assistant Examiner*—Mai T Nguyen
(74) *Attorney, Agent, or Firm*—Novak Druce + Quigg LLP

(57) ABSTRACT

An excavation device having a pair of milling wheels with a substantially horizontal axis (X) of rotation. Each milling wheel peripherally equipped with an excavation apparatus to define an excavation front substantially parallel to the axis (X). The excavation device also has a chain-type transmission to draw in rotation, in a first operating condition, each of the milling wheels. The transmission is driven by a motor and provided, on its side which is external during use, with an excavation apparatus. The excavation device also has a thruster able to be activated to selectively move the transmission into a second operating position, widened and external with respect to the first operating condition.

11 Claims, 2 Drawing Sheets

EXCAVATION DEVICE

FIELD OF THE INVENTION

The present invention concerns a device to excavate diaphragms, ditches, trenches, wells or other, having milling wheels with a horizontal axis driven by motor means connected to chain-type transmission means also equipped, on its side which is external during use, with excavation means.

The excavation device according to the present invention comprises thrust means, able to be selectively activated, for the lateral deflection of the chain-type transmission means.

BACKGROUND OF THE INVENTION

It is known to effect the excavation of diaphragms, ditches, trenches, wells or other by means of excavation devices having two pairs of milling wheels with horizontal axes and substantially parallel during use to the excavation surface, which are driven by motor means. The motion is usually transferred to the shaft of the milling wheels by means of chain-type transmission means.

For example, diaphragms are usually deep perforations with a rectangular section, which are made in continuous manner in a vertical direction in the ground and have diverse functions, such as for example of a structural type, as in the perimeter walls of an underground building, as a foundation, as in surface buildings, or again with a water-proofing function, as in works on dams.

Normally, diaphragms are excavated by first making an excavation of two diaphragms, separate and substantially aligned, which are cast with concrete or plastic cement, and subsequently, by excavating a closing diaphragm which joins together said two cast diaphragms. In the last step, a part of each of the cast diaphragms is excavated by the excavation device, so as to guarantee the cleanliness of the surfaces that will be cast, and a good anchorage of the concrete or plastic cement.

However, with known excavation devices there may be a lack of accuracy in the excavation, which can thus reduce to below the design specifications both the continuity and the linearity of the diaphragms excavated.

Moreover, the forces to which the excavation device is subjected during the excavation can make the excavation devices rotate around the vertical during the excavation, accentuating the imprecision of the excavation. This renders the diaphragms made unsuitable to perform their structural function, their foundation function, and also their sealing function as described above.

A purpose of the present invention is to achieve an excavation device which allows to make the excavation with great precision of diaphragms, ditches, trenches, wells or other, with continuity and linearity in the disposition of the excavation.

Another purpose of the present invention is to achieve an excavation method which has great precision, and continuity and linearity in the disposition of the excavation.

The Applicant has devised, tested and embodied the present invention to overcome the shortcomings of the state of the art and to obtain these and other purposes and advantages.

SUMMARY OF THE INVENTION

The present invention is set forth and characterized in the main claim, while the dependent claims describe other characteristics of the invention or variants to the main inventive idea.

In accordance with the above purposes, an excavation device according to the present invention comprises at least a pair of milling wheels with a substantially horizontal axis of rotation, each of which is peripherally equipped with excavation means able to define an excavation front substantially parallel to said axis of rotation.

The excavation device also comprises chain-type transmission means, which is able, in a first operating condition, to draw said milling wheels in rotation.

Said transmission means is driven by motor means and is also provided externally, that is, on its side which is external during use, with excavation means, so that the intermediate space between the two milling wheels of each pair is also affected by the excavation action.

According to a characteristic feature of the present invention, the excavation device also comprises thrust means, which can be activated to selectively position said chain-type transmission means in a second operating position, widened and external with respect to the first operating condition.

Advantageously, the thrust means moves the transmission means in a direction inclined with respect to the axis of rotation, substantially on the plane on which the chain-type transmission means itself lies.

According to another advantageous characteristic of the present invention, said second operating position is outside the bulk of the milling wheels, so that the excavation action of the excavation means present on the outside of the chain-type transmission means can also affect the lateral space outside the area affected by the excavation performed by the milling wheels.

By activating the thrust means, the present invention is advantageously used to also make closing diaphragms between two diaphragms excavated and cast with concrete or plastic cement.

Advantageously, by means of the present invention, great continuity and linearity of the diaphragms excavated is obtained, within the design specifications, an effective anchorage of the concrete or plastic cement cast and, consequently, a better sealing for the water-proofing functions, typically advantageous in works on dams.

According to another characteristic of the present invention, the excavation device comprises guide means able to guide the excavation device vertically during the execution of the excavation.

The guide means is positioned along said excavation device, above said thrust means, and extend laterally from the excavation device for a distance substantially equal to the lateral extension of the transmission means, when the latter is in the second operating position.

Advantageously, said guide means couples slidingly with the closing diaphragm made by means of the transmission means in the second operating condition, allowing said vertical guide of the excavation device. The latter is thus kept vertically guided, preventing unwanted rotations and the consequent reduction of the covering zones of the diaphragms excavated.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
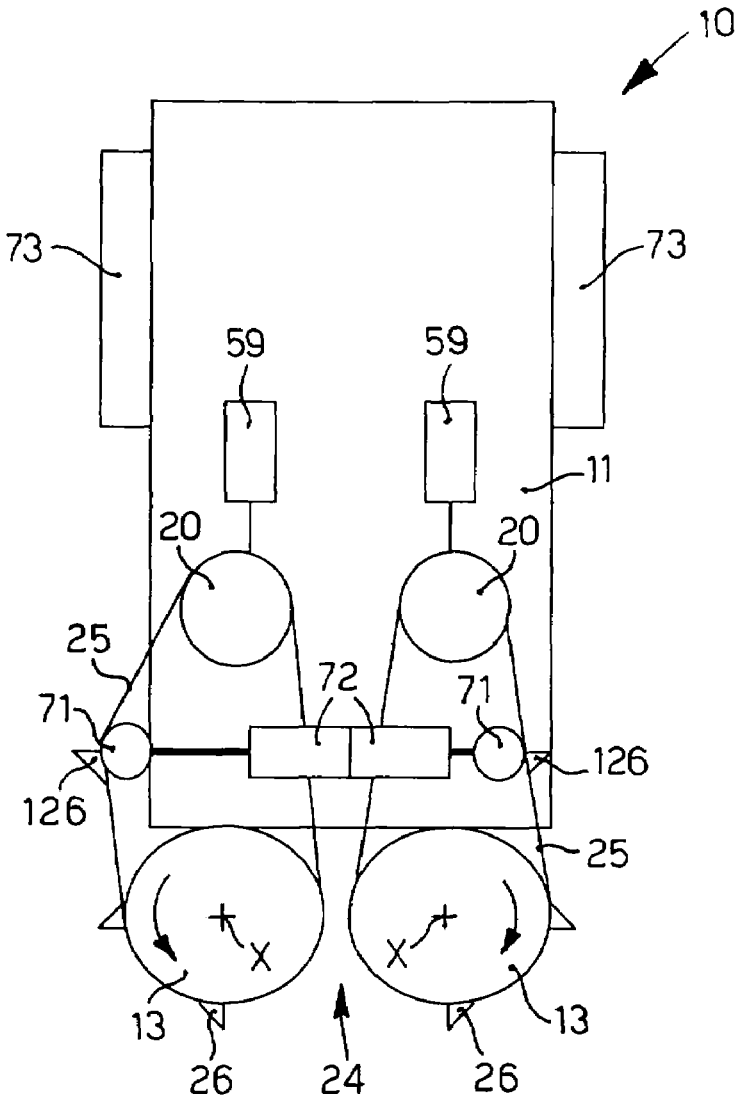
FIG. 1 is a schematic representation of an excavation device according to the present invention.

According to the present invention, FIG. 1 shows an excavation device 10, suitable to operate in every type of ground and able to make excavations, also called panels, diaphragms, ditches, trenches, wells, with a structural function, such as perimeter walls of an underground car-park, or with a foundation function, such as for a surface building, or again with a water-proofing function, usually used in works on dams.

The excavation device 10 comprises an excavation head 11 (FIG. 1), which can be carried by a self-propelled means and driven in a vertical direction by the self-propelled means itself.

From the lower part of the excavation head 11 two pairs of milling wheels 13 extend, with a substantially horizontal axis X of rotation (FIG. 1).

The milling wheels 13 define during use an excavation front 24, substantially parallel to the axis of rotation X (FIG. 1).

Each pair of milling wheels 13 is drawn in rotation by a transmission chain 25 (FIG. 1).

Each chain 25 is driven, in an operating condition in which it draws the milling wheels 13 in rotation, by a hydraulic motor 20, in this case disposed above the milling wheels 13 (FIG. 1).

Each milling wheel 13 is peripherally equipped with excavation means 26, which defines said excavation front 24 (FIG. 1).

Each chain 25 is also provided with excavation means 26 (FIG. 1), which extends on the side of the chain 25 which is external during use, that is, the side able to face towards the ground to be excavated.

According to another characteristic of the present invention, said excavation means 26 comprises on the outer side a plurality of excavation teeth 126 (FIG. 1), which are disposed offset with respect to each other, in a direction substantially transverse to the longitudinal development of said chain 25.

In this way, a progressive action of the excavation is created, which reduces the stress on the individual excavation tooth and allows to obtain a more continuous, uniform and homogeneous excavation action.

Figure 4:
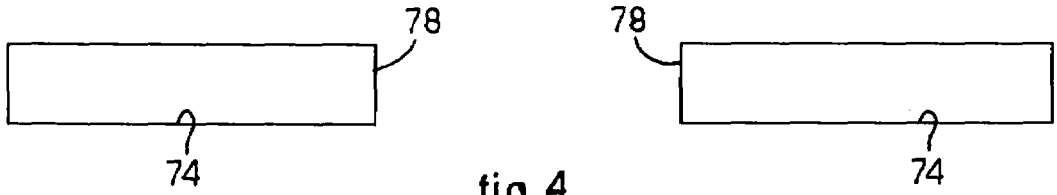
FIG. 4 is a schematic representation of two excavations according to the state of the art.

The excavation front 24 is thus continuous and uniform, without dead spaces and has a section that substantially coincides with the greater section of the excavation head 11 (FIG. 1), achieving an excavation or panel 74 (FIG. 4) with a substantially rectangular section.

The milling wheels 13 are advantageously counter-rotating, so as to balance the stresses during the excavation and to convey and draw the debris and broken materials produced by the excavation towards a central intake zone, located between the milling wheels 13 themselves (FIG. 1).

According to a characteristic feature of the present invention, the excavation device 10 also comprises thrust means 71 (FIG. 1), the horizontal position of which is substantially inside said excavation head 11, with respect to the chain 25, so as to be able to cooperate with the side of the chain 25 which during use is internal; the thrust means 71 is for example made as rollers on which the chain 25 slides, and whose vertical position is interposed between the hydraulic motor 20 and each of the respective milling wheels 13.

The thrust means 71 is able to be activated selectively, by means of actuator means 72 (FIG. 1), such as a hydraulic jack, in order to move the chain 25 in a direction inclined, advantageously substantially perpendicular, with respect to said axis X, and thus to selectively position the chain 25 in a second operating position, widened and external with respect to the first operating condition (FIG. 1).

In FIG. 1, the excavation device 10 is shown with only one chain 25 widened laterally, but usually both the chains 25 are widened by the thrust means 71.

A tensioner unit 59 (FIG. 1), advantageously sliding, acts on each of the hydraulic motors 20, keeping the tension on the chain 25 at a substantially constant force, and allows with this action to bring the motor 20 near the milling wheels 13 and, consequently, to deflect the chain 25 laterally.

Advantageously, the second operating position of the chain 25 is outside the bulk of the milling wheels 13 (FIG. 1), so as to achieve a closing excavation or panel 75 with a substantially rectangular section which has projections 76 (FIG. 6), which are determined by the greater extension or lateral deflection of the chain 25, and hence of the excavation teeth 126 disposed thereon, when the thrust means 71 is activated.

Figure 3:
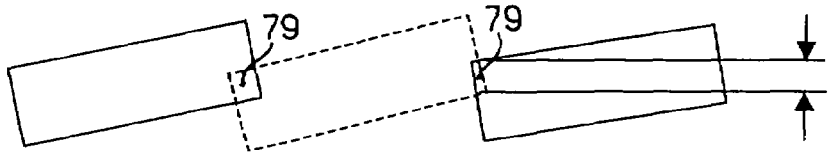
FIG. 3 is a schematic representation of the excavation of diaphragms according to the state of the art.
Figure 5:
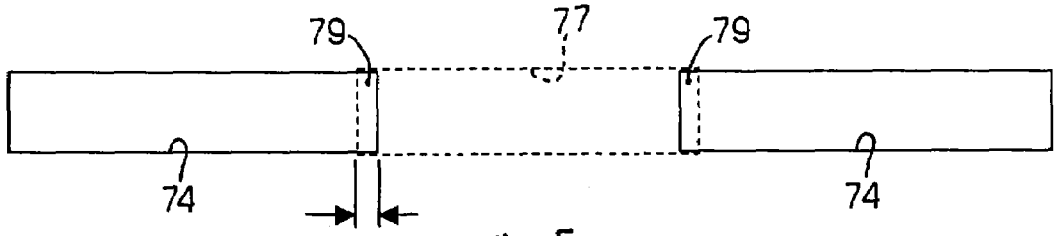
FIG. 5 is another schematic representation of a closing excavation according to the state of the art.
Figure 6:
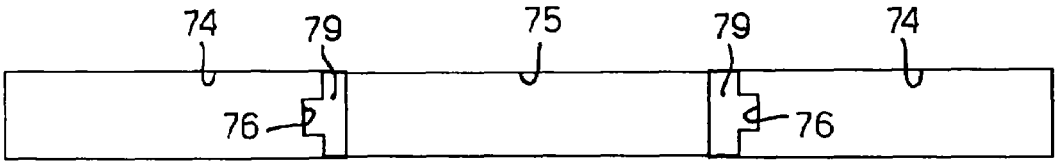
FIG. 6 is another schematic representation of a closing excavation by means of the excavation device in FIG. 1.

The present invention is extremely advantageous for making panels and diaphragms with excellent characteristics of quality. In fact, in the state of the art, after the execution of two excavations or panels 74, separated as in FIG. 4, the latter are cast with concrete and joined by excavating a closing panel 77 of a known type. The excavation is also partly effected in the two panels 74 already cast, along closing surfaces 78, and thus the closing panel 77 partly overlaps the two previous diaphragms, defining a covering zone 79 (FIGS. 5 and 6). In FIG. 3 it can be seen that, by using excavation devices known in the state of the art, the excavation of an adjacent succession of panels can entail an overall non-alignment of the excavation, and hence a reduction in the covering zones 79 between the diaphragms of the excavation.

This reduction is emphasized by the roto-translation of the points of intersection between the profiles of adjacent panels, due to the slight rotation of the milling wheels and the excavation device itself around the vertical.

By means of the present invention, after effecting the excavation of the panels 74 as previously shown (FIG. 4), the excavation of the closing panel is effected, instead, by activating the thrust means 71 too, for example automatically or manually, which forces the chain 25 towards the outside of the milling wheels 13, so as to achieve said closing diaphragm 75. Substantially, the thrust means 71 selectively achieves a lateral deflection of the chain 25, which determines the excavation of said projections 76.

The projections 76, having a profile with a segmented line (FIG. 6) which determines a tortuous path to which the concrete or plastic cement anchors, advantageously function as preferential anchorage surfaces for the concrete or plastic cement cast.

In this way, panels are achieved having extensive covering zones 79 (FIG. 6) and good continuity and linearity, within the design specifications.

The panels thus achieved also allow an effective anchorage of the concrete or plastic cement cast and consequently a better seal for the structural, foundation and waterproofing functions, the latter being typically advantageous in works on dams.

Figure 2:
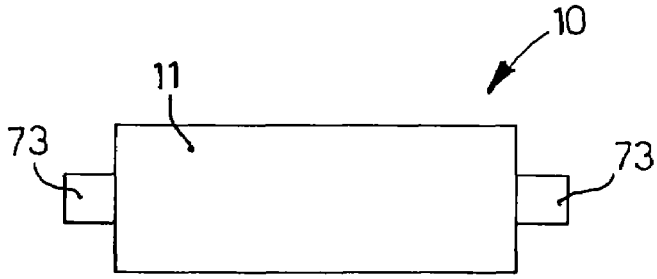
FIG. 2 is a schematic plane view of the excavation device in FIG. 1.

The excavation device 10 also comprises guide blocks 73, advantageously of the type that is retractable between a position outside and position inside the bulk of the excavation head 11, for example extendable hydraulically or manually, towards the outside of the excavation head 11, each block 73 being positioned along the sides of the excavation head 11 and aligned above said thrust means 71 (FIGS. 1 and 2).

The guide blocks 73 have a shape substantially mating with said projections 76 and, in the retracted position, come within the bulk of the excavation device 10, whereas in the extended position they extend laterally beyond the bulk of the excavation device 10 for a distance substantially equal to the lateral extension of the chain 25 when the latter is in said second operating position (FIG. 1).

Each guide block 73 is able to guide said excavation device 10 vertically during the excavation, coupling in sliding manner along the seatings of the projections 76, to prevent unwanted rotations of the milling wheels 13 around the vertical during the excavation.

It is clear that modifications and/or additions of parts may be made to the excavation device 10 as described heretofore, without departing from the scope of the present invention.

The invention claimed is:

1. Excavation device comprising:

at least a pair of milling wheels with a substantially horizontal axis (X) of rotation, each peripherally equipped with excavation means, for defining an excavation front substantially parallel to said axis (X);

chain-type transmission means for drawing in rotation, in a first operating condition, each of said milling wheels, said transmission means being driven by motor means, and also being provided on its side which is external during use with excavation means, the device further comprising thrust means suitable to be activated to selectively move only said chain-type transmission means into a second operating position, widened and external with respect to said first operating condition.

2. Device as in claim 1, wherein said second operating position is substantially outside the bulk of said milling wheels.

3. Device as in claim 1, wherein said thrust means is able to move said chain-type transmission means in a direction inclined with respect to said axis (X).

4. Device as in claim 3, wherein said thrust means is able to move said chain-type transmission means on the plane on which said chain-type transmission means lies, in a direction substantially perpendicular to said axis (X).

5. Device as claim 1, wherein said thrust means is interposed between said motor means and said milling wheels.

6. Device as in claim 1, further comprising actuator means able to drive said thrust means.

7. Device as in claim 1, further comprising guide means, able to guide said excavation device vertically during the execution of said excavation.

8. Device as in claim 7, wherein said guide means is of the retractable type, to be selectively positioned in a position inside the bulk of said excavation device and a position outside the bulk of said excavation device.

9. Device as in claim 8, wherein said guide means is positioned above said thrust means and extends laterally from said excavation device for a distance substantially equal to the lateral extension of said transmission means in said second operating position.

10. Method to execute excavation works by means of an excavation device having at least a pair of milling wheels with a substantially horizontal axis (X) of rotation, each peripherally equipped with excavation means, for defining an excavation front substantially parallel to said axis (X), and chain-type transmission means for drawing in rotation, in a first operating condition, each of said milling wheels, said transmission means being driven by motor means and also being provided, on its side which is external during use, with excavation means, comprising:

a first step to make at least two separate excavations, and a second step to make a closing excavation, in order to connect said excavations, wherein during said second step a movement of said transmission means is effected into a second operating position widened and external with respect to said first operating position.

11. Method as in claim 10, wherein said movement of said transmission means is effected by means of thrust means.

* * * * *